US007862451B2

(12) United States Patent
Harvell et al.

(10) Patent No.: US 7,862,451 B2
(45) **Date of Patent: *Jan. 4, 2011**

(54) GOLF CLUB HEAD WITH INTEGRALLY ATTACHED WEIGHT MEMBERS

(75) Inventors: Christopher D. Harvell, Escondido, CA (US); Jeffrey W. Meyer, Fallbrook, CA (US); Raymond L. Poynor, Escondido, CA (US)

(73) Assignee: Acushnet Company, Fairhaven, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/501,882

(22) Filed: Jul. 13, 2009

(65) Prior Publication Data

US 2009/0280924 A1 Nov. 12, 2009

Related U.S. Application Data

(63) Continuation of application No. 11/056,125, filed on Feb. 14, 2005, now Pat. No. 7,559,854.

(51) Int. Cl.
*A63B 53/04* (2006.01)
*A63B 53/08* (2006.01)

(52) U.S. Cl. ..... 473/334; 473/336; 473/345; 473/349

(58) Field of Classification Search ..... 473/324–350, 473/287–292

See application file for complete search history.

(56) References Cited

U.S. PATENT DOCUMENTS

| | | | | |
|---|---|---|---|---|
| 1,453,503 | A | 5/1923 | Holmes | 473/336 |
| 1,840,924 | A | 1/1932 | Tucker | 473/337 |
| 2,056,335 | A | 10/1936 | Wettlaufer | 473/245 |
| 3,652,094 | A | 3/1972 | Glover | 473/337 |
| 3,845,960 | A | 11/1974 | Thompson | 473/336 |
| 3,979,122 | A | 9/1976 | Belmont | 473/336 |
| 4,828,266 | A | 5/1989 | Tunstall | 473/336 |
| 4,869,507 | A | 9/1989 | Sahm | 473/337 |
| 4,962,932 | A | 10/1990 | Anderson | 473/336 |
| 5,013,041 | A | 5/1991 | Sun et al. | 473/252 |
| 5,058,895 | A | 10/1991 | Igarashi | 473/341 |
| 5,244,210 | A | 9/1993 | Au | 473/252 |
| 5,407,202 | A | 4/1995 | Igarashi | 473/342 |
| 5,571,053 | A | 11/1996 | Lane | 473/336 |
| 5,603,666 | A | 2/1997 | Bowe | 473/307 |
| 5,632,694 | A | 5/1997 | Lee | 473/336 |
| 5,688,189 | A | 11/1997 | Bland | 473/314 |
| 5,851,160 | A | 12/1998 | Rugge et al. | 473/349 |

(Continued)

FOREIGN PATENT DOCUMENTS

| | | |
|---|---|---|
| JP | 50-95056 | 8/1975 |

(Continued)

OTHER PUBLICATIONS

Japanese Office Action dated Jun. 22, 2009 of corresponding Japanese Patent Application No. 2006-032692.

*Primary Examiner*—Sebastiano Passaniti
(74) *Attorney, Agent, or Firm*—Hanify & King, P.C.

(57) ABSTRACT

A golf club head having integrally attached weight members is disclosed and claimed. The club head body defines at least a toe chamber and a heel chamber. Weights of variable mass are positioned within the chambers, moving the club head center of gravity back and down.

19 Claims, 2 Drawing Sheets

U.S. PATENT DOCUMENTS

| | | | | |
|---|---|---|---|---|
| 5,879,243 | A | 3/1999 | Hackman | 473/342 |
| 5,911,638 | A | 6/1999 | Parente et al. | 473/338 |
| 6,083,118 | A | 7/2000 | Martins et al. | 473/334 |
| 6,123,627 | A | 9/2000 | Antonious | 473/327 |
| 6,450,894 | B1 | 9/2002 | Sun et al. | 473/252 |
| 6,478,692 | B2 | 11/2002 | Kosmatka | 473/342 |
| 6,860,818 | B2 | 3/2005 | Mahaffey et al. | 473/256 |
| 6,923,734 | B2 | 8/2005 | Meyer | 473/336 |
| 6,945,877 | B2 * | 9/2005 | Kobayashi et al. | 473/345 |
| 7,344,450 | B2 * | 3/2008 | Billings | 473/324 |
| 7,559,854 | B2 * | 7/2009 | Harvell et al. | 473/334 |
| 7,611,424 | B2 * | 11/2009 | Nagai et al. | 473/334 |
| 7,651,410 | B2 * | 1/2010 | Shimazaki | 473/335 |
| 2002/0094884 | A1 * | 7/2002 | Hocknell et al. | 473/334 |
| 2002/0160854 | A1 * | 10/2002 | Beach et al. | 473/334 |

FOREIGN PATENT DOCUMENTS

| | | |
|---|---|---|
| JP | 61-139259 | 8/1986 |
| JP | 64-043278 | 2/1989 |
| JP | 05-000172 | 1/1993 |
| JP | 09-028844 | 2/1997 |
| JP | 2003-236025 | 8/2003 |
| JP | 2003-250937 | 9/2003 |

* cited by examiner

GOLF CLUB HEAD WITH INTEGRALLY ATTACHED WEIGHT MEMBERS

CROSS-REFERENCE TO RELATED APPLICATIONS

The present invention is a continuation of U.S. application Ser. No. 11/056,125, filed Feb. 14, 2005, now U.S. Pat. No. 7,559,854, the entirety of which is incorporated herein by reference.

BACKGROUND OF THE INVENTION

1. Field of the Invention

The present invention relates to a golf club, and, more particularly, the present invention relates to a golf club head with integrally attached weight members.

2. Description of the Related Art

Golf club heads come in many different forms and makes, such as wood- or metal-type (including drivers and fairway woods), iron-type (including wedge-type club heads), utility- or specialty-type, and putter-type. Each of these styles has a prescribed function and make-up. The present invention primarily relates to hollow golf club heads, such as wood-type and utility-type (generally referred to herein as wood-type golf clubs).

Wood-type type golf club heads generally include a front or striking face, a crown, a sole, and an arcuate skirt including a heel, a toe, and a back. The crown and skirt are sometimes referred to as a "shell." The front face interfaces with and strikes the golf ball. A plurality of grooves, sometimes referred to as "score lines," may be provided on the face to assist in imparting spin to the ball. The crown is generally configured to have a particular look to the golfer and to provide structural rigidity for the striking face. The sole of the golf club contacts and interacts with the ground during the swing.

The design and manufacture of wood-type golf clubs requires careful attention to club head construction. Among the many factors that must be considered are material selection, material treatment, structural integrity, and overall geometrical design. Exemplary geometrical design considerations include loft, lie, face angle, horizontal face bulge, vertical face roll, face size, sole curvature, center of gravity, and overall head weight. The interior design of the club head may be tailored to achieve particular characteristics, such as by including hosel or shaft attachment means, perimeter weighting on the face or body of the club head, and fillers within hollow club heads. Club heads typically are formed from stainless steel, aluminum, or titanium, and are cast, stamped as by forming sheet metal with pressure, forged, or formed by a combination of any two or more of these processes. The club heads may be formed from multiple pieces that are welded or otherwise joined together to form a hollow head, as is often the case of club heads designed with inserts, such as sole plates or crown plates. The multi-piece constructions facilitate access to the cavity formed within the club head, thereby permitting the attachment of various other components to the head such as internal weights and the club shaft. The cavity may remain empty, or may be partially or completely filled, such as with foam. An adhesive may be injected into the club head to provide the correct swing weight and to collect and retain any debris that may be in the club head. In addition, due to difficulties in manufacturing one-piece club heads to high dimensional tolerances, the use of multi-piece constructions allows the manufacture of a club head to a tight set of standards.

The distance a golf ball travels after impact with a golf club is dictated by the magnitude and direction of the ball's translational and rotational velocities. Golf ball travel distance is a function of the total kinetic energy imparted to the ball during impact with the club head, neglecting environmental effects. During impact, kinetic energy is transferred from the club and stored as elastic strain energy in the club head and the ball. After impact, the stored elastic energy is transformed back into kinetic energy in the form of translational and rotational velocity of the ball as well as of the club. Since the collision is not perfectly elastic, a portion of the energy is dissipated as heat, club head vibration, and viscoelastic relaxation of the ball. Golf ball landing accuracy also is driven by a number of factors. Some of these can be attributed to club head design. The club head center of gravity (CG) is of primary concern.

The club head CG is the point at which it is perfectly balanced. The momentum generated in the club head during a golf swing and which is transferred to the ball at impact acts through the club head CG. Lowering the club head CG below the impact point imparts an upward trajectory to the momentum vector, which translates to an upward trajectory on the resulting ball flight. Thus, lowering the club head CG allows the golfer to get the ball airborne quickly. This effect is enhanced by moving the CG back away from the club face. Getting the golf ball in the air quickly is beneficial for most golfers, especially for shots from the rough or when using a wood-type club without a tee.

Heel-to-toe positioning of the CG also has an effect on the resulting golf shot. If the CG is biased towards the heel, the club head is easier to turn over to square at impact. This arrangement is beneficial for a golfer that tends to slice the ball or keep the club face open at impact. Similarly, biasing the CG towards the toe is beneficial for a golfer that tends to hook the ball or have a closed club head posture at impact.

Moment of inertia (MOI) is also an important design aspect of golf club heads. Inertia is a property of matter by which a body remains at rest or in uniform motion unless acted upon by some external force. MOI is a measure of the resistance of a body to angular acceleration about a given axis, and is equal to the sum of the products of each element of mass in the body and the square of the element's distance from the axis. Thus, as mass distance from the axis increases, the MOI increases. As the MOI increases, the stability, playability, and forgiveness of the club head increases. Another way of saying this is that as the club head MOI increases, so does its ability to resist club twisting resulting from off-center hits. Moving the CG back away from the face increases the club head MOI. The CG location and MOI can be manipulated using weights.

SUMMARY OF THE INVENTION

The present invention provides an improved golf club head that allows the golfer to get the ball airborne more quickly. Although applicable to all types of golf clubs, for convenience the present invention will be discussed herein with respect to a fairway wood. The club head includes a body having a face, a sole, a crown, and a skirt. The body has a toe and a heel, and the body defines an interior volume. Chambers are provided in both the heel and toe sides of the body, and inserts are positioned within the chambers. The inserts are retained within the chambers by epoxy, adhesive, casting, welding, or isothermal forging.

The inserts, which preferably are weight members, and the chambers allow the golf club designer to position the club head CG with great accuracy. To provide the designer with additional design control, the chambers are not aligned. In other words, the chambers are relatively offset from each other such that one of the chambers is closer to the face than the other. Additionally or alternatively, the chambers may be angled relative the club head body. To protect the inserts, the chambers are preferably accessible from the toe and heel, but not from the sole. To further allow the designer to move the CG down toward the sole and back away from the face, a third insert may be positioned in the sole.

DESCRIPTION OF THE DRAWINGS

The present invention is described with reference to the accompanying drawings, in which like reference characters reference like elements, and wherein.

DETAILED DESCRIPTION OF THE INVENTION

Other than in the operating examples, or unless otherwise expressly specified, all of the numerical ranges, amounts, values and percentages such as those for amounts of materials, moments of inertias, center of gravity locations, loft angles and others in the following portion of the specification may be read as if prefaced by the word "about" even though the term "about" may not expressly appear with the value, amount or range. Accordingly, unless indicated to the contrary, the numerical parameters set forth in the following specification and attached claims are approximations that may vary depending upon the desired properties sought to be obtained by the present invention. At the very least, and not as an attempt to limit the application of the doctrine of equivalents to the scope of the claims, each numerical parameter should at least be construed in light of the number of reported significant digits and by applying ordinary rounding techniques.

Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard deviation found in their respective testing measurements. Furthermore, when numerical ranges of varying scope are set forth herein, it is contemplated that any combination of these values inclusive of the recited values may be used.

Figure 1:
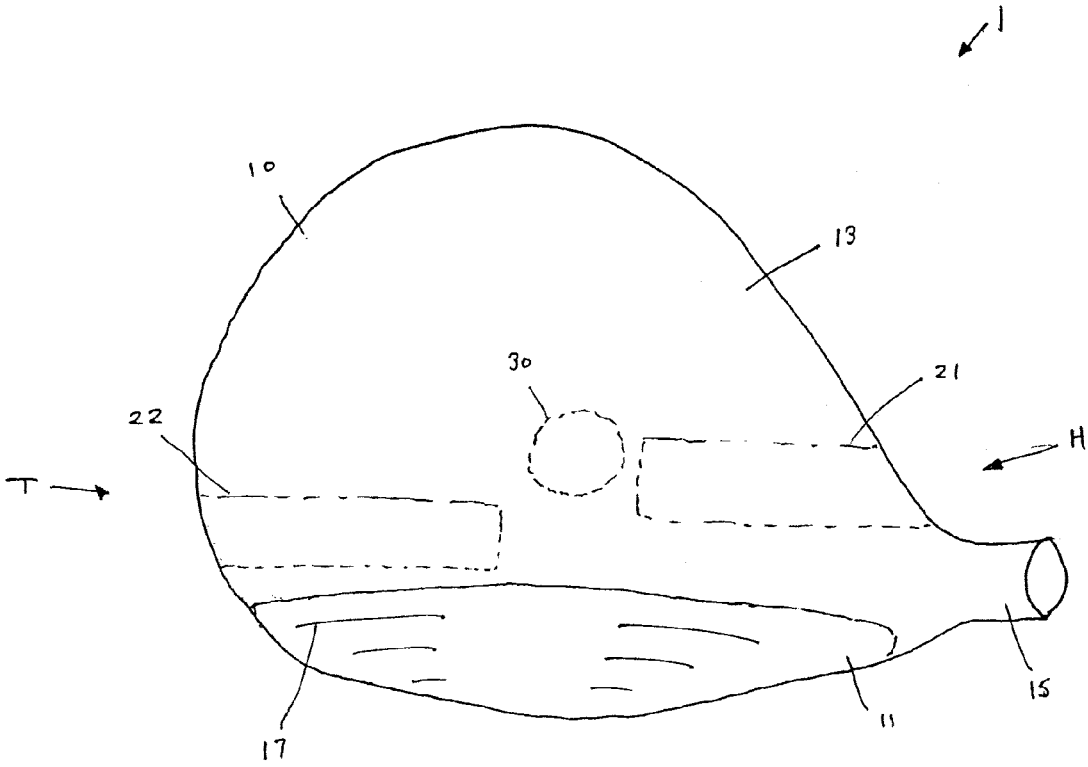
FIG. 1 shows a top view of a golf club head of the present invention.
Figure 2:
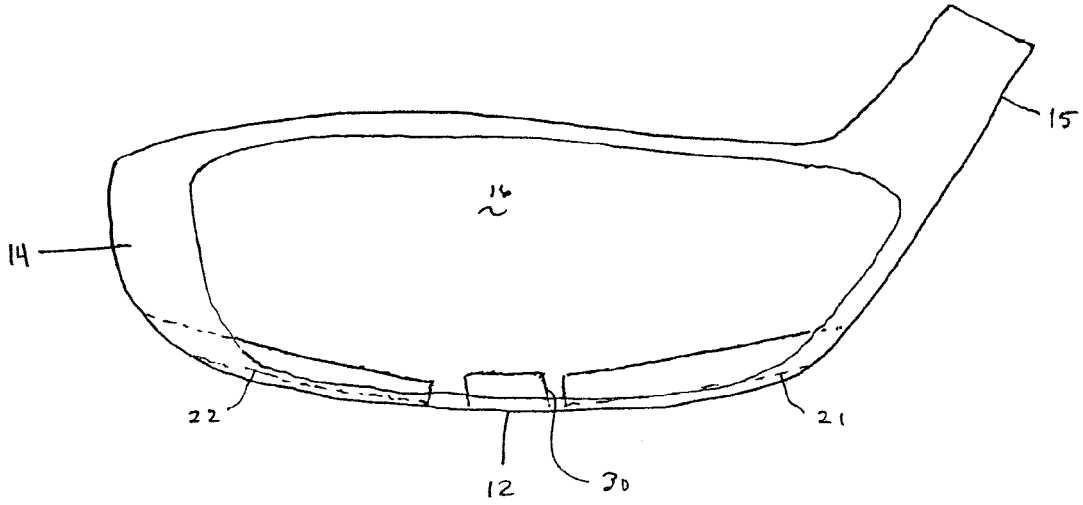
FIG. 2 shows a partially cut-away front view of the golf club head of FIG. 1.

The present invention relates to a golf club head with integrally attached weight members. FIG. 1 shows a top view of a golf club head 1 of the present invention, and FIG. 2 shows a partially cut-away front view of the golf club head 1. The club head 1 includes a body 10 having a face 11, a sole 12, a crown 13, a skirt 14, and a hosel 15. The body 10 defines a hollow, interior volume 16. Foam or other material may partially or completely fill the interior volume 16. The face 11 may be provided with grooves or score lines 17 therein of varying design. The club head 1 has a toe T and a heel H. It may be beneficial to provide the face 11 as a face insert that is coupled to the body 10 in known fashion, which would allow the club designer access to the interior volume 16.

A first chamber 21 is provided within the interior volume 16 on the heel side H of the club head 1, and a second chamber 22 is provided within the interior volume 16 on the toe side T of the club head 1. The chambers 21, 22 extend through the body 10 into the interior volume 16. A first insert is positioned within the first chamber 21, and a second insert is positioned within the second chamber 22. The first and second inserts preferably may be weight members. The weight members maybe retained within the chambers 21, 22 by any appropriate means, such as by press-fitting, epoxy, adhesive, casting, welding, or isothermal forging.

Chambers 21, 22 advantageously allow the club designer to integrally attach weight members within the interior volume 16. This allows the club designer to position the club head CG as desired pursuant to the intended golfer's swing. For example, the designer can place a weight of greater mass in the heel chamber 21 to bias the CG toward the heel H. As this setup makes the club head 1 easier to turn over to square at impact, it is beneficial for a golfer that tends to slice the ball or leave the club head open at impact. Alternatively, the designer can place a weight of greater mass in the toe chamber 22 to bias the CG toward the toe T. As this setup makes the club head more difficult to turn over, it is beneficial for a golfer that tends to hook the ball or close the club head too much at impact. Alternatively, the designer can use weights to position the club head CG in a central location between the heel H and the toe T. As shown in the illustrated embodiment, the chambers 21, 22 may be offset, or positioned such that one of the chambers 21, 22 is closer to the face 11 than the other. This design provides the club designer with another dimension of control when positioning the club head CG, allowing the designer to specifically pinpoint the CG as desired. While the chambers 21, 22 are shown in the illustrated embodiment as being substantially perpendicular to the body 10 and substantially parallel to the face 11, the chambers 21, 22 could be angled relative the body 10 and face 11. An angled chamber orientation may provide the club designer with even greater CG positioning control. Due to its density, tungsten is a preferred material for the weight members.

Placing weights within the chambers 21, 22 also has the benefit of lowering the club head CG toward the sole 12. This facilitates getting the golf ball airborne after impact, which would benefit many golfers. This is especially true for shots from the rough or when using a club with a low loft angle, such as a fairway wood. Fairway wood club heads typically have a volume from 100 cubic centimeters to 250 cubic centimeters, and more particularly from 150 cubic centimeters to 200 cubic centimeters.

The chambers 21, 22 preferably are accessible from the toe T and the heel H. This allows the weight members to be inserted into the chambers 21, 22 from the sides without having to go through the sole 12. Avoiding sole entry is desirable because if the weight members are exposed through the sole 12, they may be damaged and even become dislodged by contact with the golf course turf during normal use of the club. While this possibility may be remote, providing heel and toe access to the chambers eliminates any potential problems.

The club head 1 may be provided with a third insert 30. A preferred embodiment of the third insert 30 is a screw inserted through the sole 12. Use of the third weight member 30 further allows the designer to position the club head CG, such as by lowering it and moving it back away from the face 11.

In an exemplary club head of the present invention, both the heel and toe weight members have masses from 1 to 50 grams. More specifically, the heel weight member has a mass from 25 grams to 50 grams and the toe weight member has a mass from 1 gram to 25 grams. These weight member masses allowed the club designer to position the CG from 10 millimeters to 50 millimeters behind the face. More specifically, the CG is positioned from 20 millimeters to 35 millimeters behind the face.

While the preferred embodiments of the present invention have been described above, it should be understood that they have been presented by way of example only, and not of limitation. It will be apparent to persons skilled in the relevant art that various changes in form and detail can be made therein without departing from the spirit and scope of the invention. Thus the present invention should not be limited by the above-described exemplary embodiments, but should be defined only in accordance with the following claims and their equivalents. Furthermore, while certain advantages of the invention have been described herein, it is to be understood that not necessarily all such advantages may be achieved in accordance with any particular embodiment of the invention. For example, while the invention has been described above with respect to a fairway wood-type golf club, the invention is equally applicable to other wood-type clubs, iron-type clubs, hybrid clubs, and putters. Thus, for example, those skilled in the art will recognize that the invention may be embodied or carried out in a manner that achieves or optimizes one advantage or group of advantages as taught herein without necessarily achieving other advantages as may be taught or suggested herein.

What is claimed is:

1. A wood-type golf club head, comprising:

a body including a face, a sole, a crown, and a skirt, wherein the body comprises a toe and a heel and defines an interior volume;

a first elongated chamber within the body accessible from the exterior at the heel and extending towards the toe;

a first weight member positioned within the first chamber;

a second elongated chamber within the body accessible from the exterior at the toe and extending towards the heel, a second weight member positioned within the second chamber;

wherein one of the first and second weight members is located closer to the face than the other.

2. The golf club head of claim 1, wherein the first and second elongated chambers extend longitudinally substantially parallel to the face.

3. The golf club head of claim 1, wherein the face is a face insert coupled to the body.

4. The golf club head of claim 1, wherein at least one of the first and second weight members comprises tungsten.

5. The golf club head of claim 1, wherein the golf club head has a center of gravity located from 10 millimeters to 50 millimeters behind the face.

6. The golf club head of claim 5, wherein the golf club head has a center of gravity located from 20 millimeters to 35 millimeters behind the face.

7. The golf club head of claim 1, further comprising a third weight member coupled to the sole.

8. The golf club head of claim 1, the first weight member has a mass from 1 to 50grams and the second weight member has a mass from 1 to 50 grams.

9. The golf club head of claim 1, wherein the first weight member has a first mass and the second weight member has a second mass greater than the first mass.

10. The golf club head of claim 1, wherein the first weight member has a first mass and the second weight member has a second mass less than the first mass.

11. A wood-type golf club head, comprising:

a body including a face, a crown, and a skirt, the body comprising a toe and a heel and defining an interior volume;

a first chamber accessible from the exterior at a heel side of the body extending toward the toe side of the body;

a first weight member coupled within the first chamber;

a second chamber accessible from the exterior at a toe side of the body extending toward the heel side of the body;

a second weight member coupled within the first chamber, wherein one of the first or second chambers is located closer to the face than the other chamber, and wherein the first weight member has a first mass and the second weight member has a second mass greater than the first mass.

12. The golf club head of claim 11, wherein the first mass is from 1gram to 50 grams and the second mass is from 1 gram to 50 grams.

13. The golf club head of claim 11, wherein the body further comprises a third weight member.

14. The golf club head of claim 13, wherein the body further comprises a sole, and wherein the third weight member is coupled to the sole.

15. A wood-type golf club head, comprising:

a body including a face, a crown, and a skirt, the body comprising a toe and a heel and defining an interior volume;

a first chamber accessible from the exterior at a heel side of the body extending toward the toe side of the body;

a first weight member coupled within the first chamber;

a second chamber accessible from the exterior at a toe side of the body extending toward the heel side of the body;

a second weight member coupled within the first chamber;

wherein one of the first or second chambers is located closer to the face.

16. The golf club head of claim 15, wherein the first weight member has a first mass and the second weight member has a second mass greater than the first mass.

17. The golf club head of claim 15, wherein the first weight member has a first mass and the second weight member has a second mass less than the first mass.

18. The golf club head of claim 15, further comprising a third weight member coupled to the sole.

19. The golf club head of claim 15, wherein at least one of the first and second chambers are angled relative to the body and face.

* * * * *